US006793774B2

(12) United States Patent
Lyytinen

(10) Patent No.: US 6,793,774 B2
(45) Date of Patent: Sep. 21, 2004

(54) ARRANGEMENT OF HIGH-PRESSURE WATER DEVICES IN A PAPER MACHINE AND A METHOD FOR ARRANGING IT IN A PAPER MACHINE

(75) Inventor: Markku Lyytinen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 77 days.

(21) Appl. No.: 10/246,149

(22) Filed: Sep. 16, 2002

(65) Prior Publication Data

US 2003/0062140 A1 Apr. 3, 2003

(30) Foreign Application Priority Data

Sep. 28, 2001 (FI) ..... 20011901

(51) Int. Cl.[7] ..... D21F 1/34; D21G 9/00

(52) U.S. Cl. ..... 162/195; 162/286; 162/252; 162/260; 137/565.11; 137/565.29

(58) Field of Search ..... 162/189, 190, 162/195, 198, 199, 252, 253, 260, 262, 263, 264, 286, 272–275, DIG. 7; 700/127–129, 282, 283; 137/9, 14, 118.01, 565.01, 565.11, 565.29, 565.33

(56) References Cited

U.S. PATENT DOCUMENTS 2,771,823 A * 11/1956 Lukemire ..... 162/190
5,783,044 A 7/1998 Schneider et al. ..... 162/278
6,190,504 B1 * 2/2001 Karlsson et al. ..... 162/190

* cited by examiner

*Primary Examiner*—Steven P. Griffin
*Assistant Examiner*—Eric Hug
(74) *Attorney, Agent, or Firm*—Fildes & Outland, P.C.

(57) ABSTRACT

An arrangement of high-pressure water devices in a paper machine including two or more consecutive sub-totalities for making paper is disclosed and includes pump devices for producing high-pressure water, high-pressure water operating devices located in a sub-totality, arranged in various consumption points, and connections to lead high-pressure water from the pump devices to the operating devices. The pump devices include at least one pump unit, from which connections are arranged to various consumption points, which belong to two or more consecutive sub-totalities. A method for arranging a high-pressure water device in a paper machine is also disclosed.

10 Claims, 2 Drawing Sheets

ARRANGEMENT OF HIGH-PRESSURE WATER DEVICES IN A PAPER MACHINE AND A METHOD FOR ARRANGING IT IN A PAPER MACHINE

FIELD OF THE INVENTION

This invention relates to an arrangement of high-pressure water devices in a paper machine including two or more consecutive sub-totalities for making paper, such as a wire section, a press section, a drying section, and a finishing section, and which water device arrangement includes pump devices for producing high-pressure water, water operating devices, located in a sub-totality and fitted at various consumption points, and connections for leading the high-pressure water from the pump devices to the operating devices. The invention also relates to a method for arranging a high-pressure device in a paper machine.

BACKGROUND OF THE INVENTION

Water is used in numerous different points in a paper machine. Simple operating equipment is used to provide a pressure and a volume flow that are usually sufficient for washing and lubricating purposes. Modern paper machines also include several devices operated by high-pressure water. The most common of such devices are oblique and edge cutters and washers. Such devices generally have a pressure of more than 250 bar and a volume flow of less than 1 l/min. A single paper machine has several different devices using high-pressure water, which are located at different consumption points and are made by several different manufacturers. Each device's manufacturer usually designs their own part and supplies the necessary accessories for the paper machine.

The present manner of arranging the devices in a paper machine leads to overlaps in design work and especially to pump capacity duplication. This is a significant disadvantage, as high-pressure water pumps cost considerably more than other water pumps to purchase and operate. In addition, a single paper machine will often incorporate very different kinds of high-pressure water pumps, demanding a large number of different spare parts and extensive servicing know-how. The co-ordination of the control of different devices also requires additional planning and accessories.

SUMMARY OF THE INVENTION

The invention is intended to create a new type of arrangement of high-pressure water devices in a paper machine, resulting in cheaper and simpler construction than existing arrangements. In addition, the invention is intended to create a new type of method for arranging an arrangement of high-pressure water devices in a paper machine, which will allow excess and insufficient capacity to be avoided in the pump devices and which will be easier and faster to implement.

The characteristic features of the water device arrangement according to the invention are provided in an arrangement of high-pressure water devices in a paper machine including two or more consecutive sub-totalities for making paper, such as a wire section, a press section, a dryer section, and a finishing section, and which water device arrangement includes pump devices for producing high-pressure water, high-pressure water operating devices located in a sub-totality and arranged at various consumption points, and connections to lead high-pressure water from the pump devices to the operating devices, and are characterized in that the pump devices include at least one pump unit, from which connections are arranged to the various consumption points belonging to two or more consecutive sub-totalities.

Correspondingly, the characteristic features of a method according to the invention for arranging a high-pressure water arrangement in a paper machine including two or more consecutive sub-totalities for making paper, such as a wire section, a press section, a dryer section, and a finishing section, and in which method suitable operating devices and pump devices corresponding to them are selected for the separate consumption points of each sub-totality, is characterized in that the total capacity requirement of the pump devices is determined, and the total capacity of the pump devices is distributed between the various consumption points arranged in the different sub-totalities.

In the water device arrangement according to the invention, hereinafter more simply the arrangement, pump devices are used, which are surprisingly formed from considerably fewer pump units than in known arrangements. Additionally, the capacity of the pump devices is divided between different consumption points. Thus the purchasing and operating costs of the pump devices are lower than before. The arrangement is also simple to design and manufacture. In the method according to the invention, the total required capacity of the pump devices is taken into account. In addition, the total capacity is divided between the different consumption locations. The paper machine totality can therefore be implemented using the most rational pump devices possible.

These and other features and advantages of the invention will be more fully understood from the following detailed description of the invention taken together with the accompanying drawings.

DETAILED DESCRIPTION OF THE INVENTION

Figure 1:
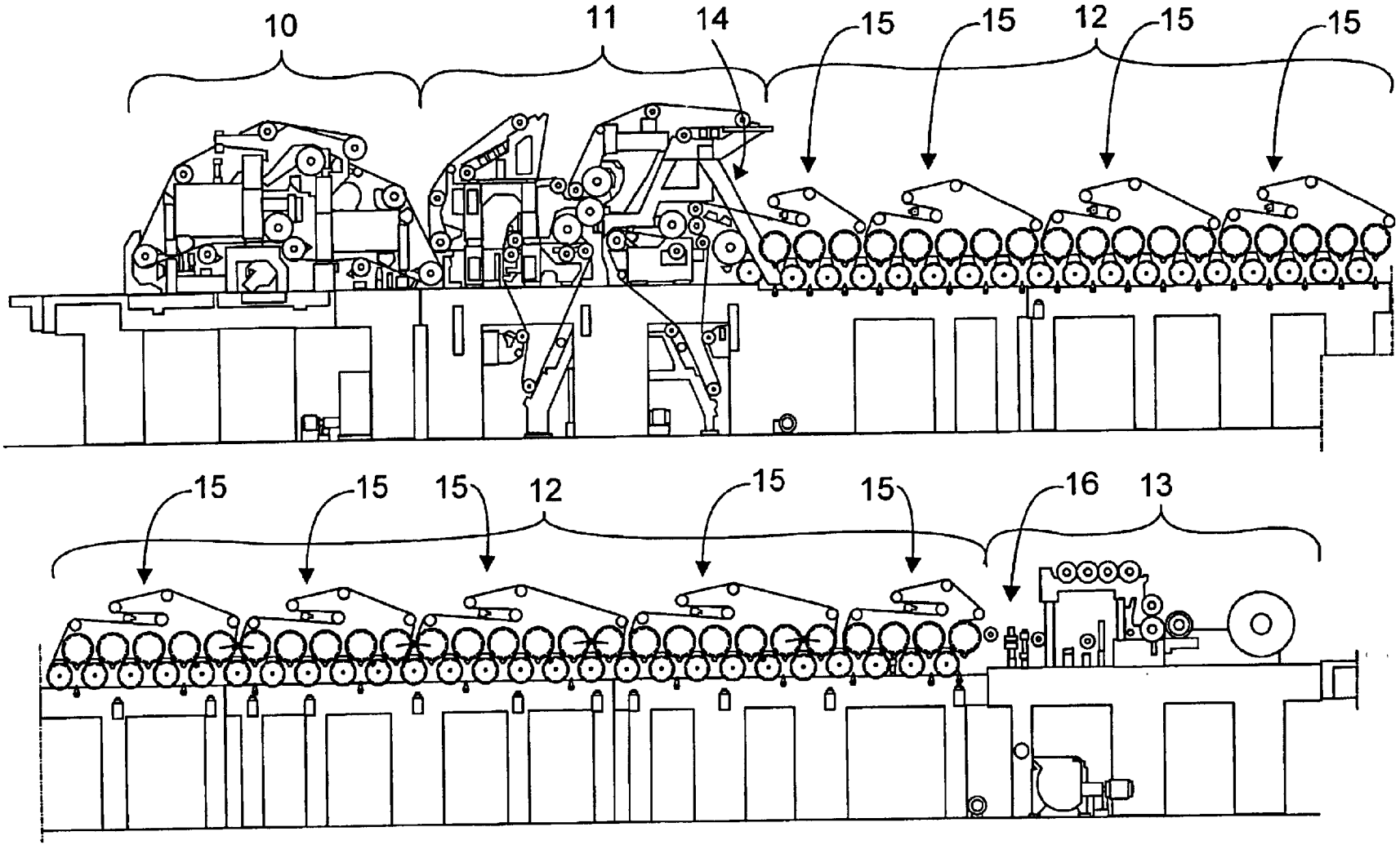
FIG. 1 shows a side view of a paper machine equipped with the water device arrangement according to the invention.

FIG. 1 shows a side view of one paper machine. The water device arrangement according to the invention, hereinafter more simply the arrangement, can also be exploited in board machines and similar machines. Generally a paper machine includes two or more consecutive sub-totalities for manufacturing paper. In the paper machine of FIG. 1, the consecutive sub-totalities that are, as such, known are a wire section 10, a press section 11, a dryer section 12, and a finishing section 13. Generally the arrangement includes pump devices for producing high-pressure water and high-pressure water operating devices located in the sub-totality and fitted at various consumption points. In addition, the arrangement includes connections for leading the high-pressure water from the pump devices to the operating devices. FIG. 1 shows only the various consumption points 14–16 while correspondingly FIG. 2 shows only the pump devices 17 and the connections 18.

Figure 2:
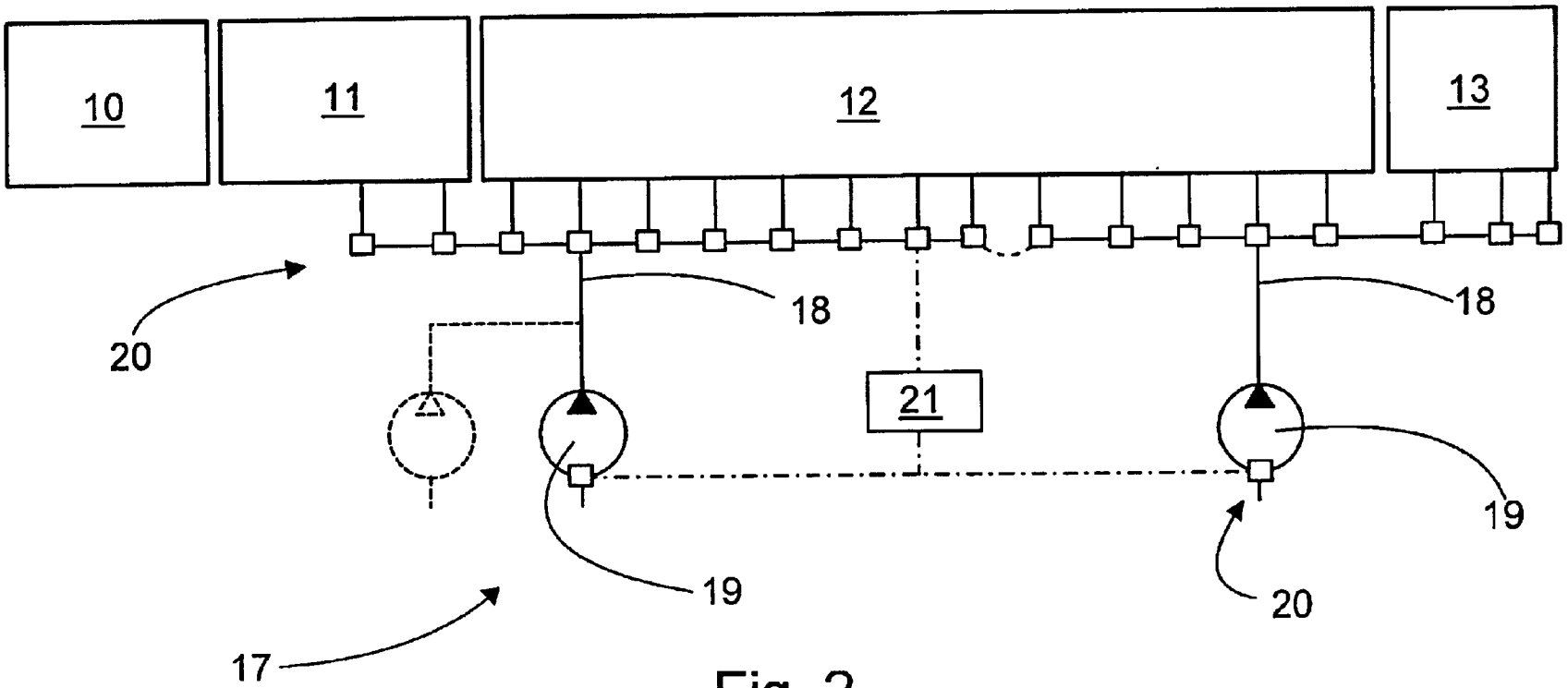
FIG. 2 shows a schematic drawing of a paper machine equipped with the water device arrangement according to the invention, seen from above.

According to the invention, the pump devices 17 include at least one pump unit 19, from which connections 18 are arranged to the various consumption points (FIG. 2). In addition, the consumption points belong to two or more consecutive sub-totalities 10–13. This reduces the total number of pump devices and particularly avoids excess capacity. In addition, the arrangement becomes easier to design. The pump units comprise high-pressure water pumps that are, as such, known, of which there are 1–4, preferably 1–2, in the arrangement according to the invention. At present, a single paper machine can have a total of 5–10 and even more different high-pressure water pumps of different sizes.

The different types of operating devices have varying periods of operation. Therefore the pump capacity required also varies. The arrangement according to the invention includes sensor and control devices 20 for distributing the high-pressure water to the different kinds of operating devices and/or to those fitted to the different sub-totalities 10–13 (FIG. 2). Thus the pump devices economically cover the various consumption points. The sensor and control device settings can be preset, or they can be altered as required, either manually or automatically, for example, if the pump capacity is insufficient. If the use of high-pressure water exceeds the total capacity of the pump devices, the sensor and control devices are arranged to limit the flow in connections leading to less critical consumption points. This will provide sufficient high-pressure water at the critical consumption points. On the other hand, the control can be used to reduce the total capacity of the pump devices as far as possible. The sensor and control devices can either be part of an operating device, or else can be located in a connection leading to an operating device, according to FIG. 2. In addition, the sensor and control devices can be advantageously connected to the centralized control system 21 (FIG. 2). The control devices can also be used to regulate the pump devices to provide a suitable pressure level and volume flow to the operating devices being used at any time.

The most usual operating devices comprise water cutters and/or water washers utilizing high-pressure water, which, according to the invention, are arranged at the various consumption points. According to the preferred embodiment of FIG. 2, the operating devices arranged at the start of the paper machine's press section 11 and dryer section 12 are connected to a single pump unit 19. Correspondingly, the operating devices arranged at the end of the dryer section 12 and the finishing section 13 are connected to a second pump unit 19. Thus the entire paper machine has only two pump units, instead of the conventional 5–10. The same reference numbers are used for operationally similar components. In addition, the pump capacity can be easily increased by connecting an additional pump unit to the pump devices. On the other hand, one pump unit can be kept in reserve. These embodiments are shown by the left-hand high-pressure pump shown by a broken line in FIG. 2. If necessary, the connections can be joined to form a single totality, making it possible to maintain operation with only a single pump unit. Of course, in that case only some of the consumption points can be operated. In FIG. 1, the consumption points 14 and 15 are oblique cutters in the press section 11 and wire washers in the dryer section 12. In this case, the edge cutters are the only consumption point 16 in the finishing section. There are also finishing sections, which have, for example, wire washers after the coating device and oblique cutters before the calender. Other consumption points are also possible.

At present, suitable operating devices with their corresponding pump devices are selected for the various consumption points of the sub-totality. This results in a large number of different components and also often in a considerable excess capacity in the pump devices. These drawbacks are avoided with the aid of the method according to the invention, in which the total capacity required by the pump devices is determined first. Next, the total capacity of the pump devices is distributed between the various consumption points arranged in the different sub-totalities. This avoids excess capacity. In addition, the pump devices comprise pump units, which are preferably identical, or at least similar. Thus the paper machine has preferably only a single type of pump unit, the maintenance of which demands fewer spare parts and less servicing know-how than conventionally. It is also easy to control and to combine the control of the pump units with other existing systems.

The fact that the operating devices work in different ways makes it possible to use the method to achieve a very small total capacity of the pump devices. This is possible by arranging the operating devices to be operated alternately. The following depicts two example embodiments, which can be used either to reduce the total capacity, or to ensure the operation of critical devices. In the first embodiment, the paper machine has a press section followed by a dryer section, with water cutters arranged as the operating devices in the press section and water washers in the dryer section. According to the invention, at least one of the water washers is taken out of operation when the water cutters are being used. This is possible in practice too, as the water cutter is used for oblique cutting during threading. Correspondingly, during threading there is little dirtying of the wire in the dryer section. If it is impossible to take a water washer out of operation, the movement or water consumption of the water washers can be reduced. The pump capacity will then be sufficient for the water cutters in the press section too. Once cutting has been completed, the water washers are returned to normal operation. The distribution of the pump capacity is advantageously implemented using automatic control, which can shut off one or more preferably predefined operating devices. Once the situation returns to normal, the preferably automatic control once again turns on the shut-off operating devices.

The second embodiment is similar to the above, but is located at the tail of the paper machine. In this case, the paper machine has a dryer section followed by a finishing section, with water washers arranged as the operating devices in the dryer section and water cutters in the finishing section. According to the invention, at least one of the water washers is shut off when the water cutters are being used. This arrangement achieves the advantages referred to above.

The arrangement according to the invention is easy and economical to use. Its cost is also lower than previous arrangements. The use of the method according to the invention avoids excess pump-device capacity. In practice, it is possible to achieve a capacity requirement that is even less than the nominal consumption, as the method takes into account the various operating periods of the operating devices. In other words, when some operating devices are running, others are not. The use of only a few pump units connected to a variety of operating devices avoids having pump units standing idle. Moreover, the centralized pump devices permit pump capacity to be easily increased, and provide a simple and fast stand-by system for fault situations.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An arrangement of high-pressure water devices in a paper machine including two or more consecutive sub-totalities for making paper, such as a wire section, a press section, a dryer section, and a finishing section, and which water device arrangement includes pump devices for producing high-pressure water with pressure of more than 250 bar, high-pressure water operating devices located in a sub-totality and arranged at various consumption points, and connections to lead high-pressure water from the pump devices to the operating devices, which comprise water cutters and/or water washers utilizing high-pressure water, characterized, in that the pump devices include at least one pump unit, from which connections are arranged to the various consumption points belonging to two or more consecutive sub-totalities, and the operating devices are arranged at separate consumption points.

2. An arrangement according to claim 1, characterized in that the pump units comprise high-pressure water pumps, there being 1–4, pumps in the arrangement.

3. An arrangement according to claim 1, characterized in that the arrangement includes sensor and control devices for distributing the high-pressure water between the different operating devices and/or those arranged in the different sub-totalities.

4. An arrangement according to claim 3, characterized in that the sensor and control devices are arranged to limit the flow in the connections leading to the less critical consumption points, should the use of high-pressure water exceed the total capacity of the pump devices.

5. An arrangement according to claim 1, characterized in that the operating devices arranged at the start of the press section and dryer section of the paper machine are connected to one pump unit and the operating devices arranged at the end of the dryer section and in the finishing section are connected to a second pump unit.

6. A method for arranging a high-pressure water arrangement in a paper machine including two or more consecutive sub-totalities for making paper, such as a wire section, a press section, a dryer section, and a finishing section, and in which method suitable operating devices, comprising water cutters and/or water washers utilizing high-pressure water and pump devices for producing high-pressure water with pressure of more than 250 bar corresponding to them are selected for the separate consumption points of each sub-totality, characterized in that the total capacity requirement of the pump devices is determined, and the total capacity of the pump devices is distributed between the various consumption points arranged in the different sub-totalities.

7. A method according to claim 6, characterized in that the pump devices comprise pump units generally of the same type.

8. A method according to claim 6, characterized in that the various operating devices are arranged to be operated alternately, in order to achieve the smallest possible total capacity of the pump devices.

9. A method according to claim 8, characterized in that the paper machine's two consecutive sub-totalities comprise a press section and a dryer section, in which water cutters are arranged as operating devices in the press section and water washers as operating devices in the dryer section, at least one of the said water washers being shut off when the water cutters are operated.

10. A method according to claim 8, characterized in that the paper machine's two consecutive sub-totalities comprise a dryer section and a finishing section, in which water washers are arranged as operating devices in the dryer section and water cutters as operating devices in the finishing section, at least one of the said water washers being shut off when the water cutters are operated.

* * * * *